US006330773B1

(12) United States Patent
MacDonald et al.

(10) Patent No.: US 6,330,773 B1
(45) Date of Patent: Dec. 18, 2001

(54) STACKING BRACKET FOR PARTITIONS

(75) Inventors: Douglas B. MacDonald, Caledonia; Jonathan J. King, East Grand Rapids; Steven E. Sanders, Byron Center; Alan E. Rheault, Grand Rapids; James R. Dykstra, Grandville, all of MI (US); Michael L. Waalkes, Athens, AL (US); David A. Walz, Grand Rapids, MI (US); Patricia A. Williams, East Grand Rapids, MI (US); Donald P. Gravel, Toronto (CA); Joseph Chang, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/293,196

(22) Filed: Apr. 16, 1999

(51) Int. Cl.[7] ..... E04H 1/00

(52) U.S. Cl. ..... 52/239; 52/36.1; 52/36.6; 52/220.7; 52/220.8; 52/243

(58) Field of Search ..... 52/239, 36.1, 36.6, 52/571, 220.7, 220.8, 580, 588.1, 271, 243, 726.3, 733.2, 736.1

(56) References Cited

U.S. PATENT DOCUMENTS

| | | | |
|---|---|---|---|
| 2,636,224 | 4/1953 | Murdoch et al. . | |
| 2,777,172 | 1/1957 | Debbink . | |
| 3,180,459 | 4/1965 | Liskey, Jr. . | |
| 3,691,709 | 9/1972 | Ostborg . | |
| 3,782,061 | 1/1974 | Minutoli et al. . | |
| 4,435,927 | 3/1984 | Umezu et al. . | |
| 4,531,564 | 7/1985 | Hanna . | |
| 4,535,577 | 8/1985 | Tenser et al. . | |
| 4,685,255 | 8/1987 | Kelley . | |
| 4,694,621 | 9/1987 | Locke . | |
| 4,726,567 | 2/1988 | Greenberg . | |
| 4,986,038 | 1/1991 | Backer . | |
| 5,038,539 | 8/1991 | Kelley et al. . | |
| 5,058,347 | 10/1991 | Schuelke et al. . | |
| 5,070,666 | 12/1991 | Looman . | |
| 5,155,955 | 10/1992 | Ball et al. . | |
| 5,277,007 | 1/1994 | Hellwig et al. . | |
| 5,287,666 | 2/1994 | Frascaroli et al. . | |
| 5,394,658 | 3/1995 | Schreiner et al. . | |
| 5,394,668 | 3/1995 | Lim . | |
| 5,412,913 | 5/1995 | Daniels et al. . | |
| 5,449,169 * | 9/1995 | Hardin et al. | 473/408 |
| 5,490,357 | 2/1996 | Lin . | |
| 5,561,960 | 10/1996 | Minnick . | |
| 5,772,166 * | 6/1998 | Adams | 248/231.81 |
| 5,787,675 | 8/1998 | Futagi . | |
| 5,806,258 | 9/1998 | Miedema et al. . | |

* cited by examiner

*Primary Examiner*—Carl D. Friedman
*Assistant Examiner*—Jennifer I. Thissell
(74) *Attorney, Agent, or Firm*—Price, Heneveld, Cooper, DeWitt & Litton

(57) ABSTRACT

An extension panel for connection to a lower panel of the type having vertical uprights defining upper ends and including a utilities passageway extending along an upper edge of the lower panel for receiving utility conduits therein. The extension panel includes a pair of space-apart upright posts, and at least one beam extending between the posts and rigidly interconnecting the same. A pair of structural members extend downwardly from the lower ends of the posts to engage the lower panel and rigidly interconnect the extension panel and the lower panel. The structural members are laterally spaced-apart to define a downwardly-opening utilities opening therebetween. The utilities opening is positioned in alignment with the utilities passageway of the lower panel to permit utilities conduits to pass through the utilities opening when the extension is secured to the lower panel.

33 Claims, 10 Drawing Sheets

STACKING BRACKET FOR PARTITIONS

CROSS-REFERENCES TO RELATED APPLICATIONS

The present application is related to commonly assigned, co-pending U.S. patent application Ser. No. 09/060,913, filed Apr. 15, 1998, entitled KNOCK-DOWN PORTABLE PARTITION SYSTEM, and commonly assigned, co-pending U.S. patent application Ser. No. 08/914,664, filed Aug. 19, 1997, entitled KNOCK-DOWN PORTABLE PARTITION SYSTEM, and commonly assigned, co-pending U.S. patent application Ser. No. 08/856,995, filed May 15, 1997, entitled KNOCK-DOWN PORTABLE PARTITION SYSTEM, each of which is hereby incorporated by reference.

BACKGROUND OF THE INVENTION

The present invention relates to office partition panel systems, and in particular to a stacking partition configured for quick and easy on-site manual assembly.

The efficient use of building floor space is an ever-growing concern, particularly as building costs continue escalating. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable or portable partition panels that are detachably interconnected to partition off the open spaces into individual workstations and/or offices. Such partition panels have sufficient structural strength to receive hang-on furniture units, such as worksurfaces, overhead cabinets, shelves, etc., and are generally known in the office furniture industry as "systems furniture." Such partition panels have an acoustical sound-absorbing configuration to promote a quiet, pleasant work environment.

In an effort to accommodate the changing requirements of the users, "stacking" panel systems have been developed to permit the height of a partition panel to be extended if required for a particular application. Known stacking panel systems may be difficult to install, and further, the stacking panel may interfere with the routing of communications and/or power lines through the partition system. Furthermore, because of the increased height, and/or structural limitations of the stacking panel, mounting of a standard storage bin or shelf to the stacking panel may present safety concerns. Accordingly, a stacking panel system alleviating the above-identified problems is desired.

SUMMARY OF THE INVENTION

One aspect of the present invention is an extension panel for connection to a lower panel of the type having vertical uprights defining upper ends and including a utilities passageway extending along an upper edge of the lower panel for receiving utility conduits therein. The extension panel includes a pair of space-apart upright posts, and at least one beam extending between the posts and rigidly interconnecting the same. A pair of structural members extend downwardly from the lower ends of the posts to engage the lower panel and rigidly interconnect the extension panel and the lower panel. The structural members are laterally spaced-apart to define a downwardly-opening utilities opening therebetween. The utilities opening is positioned in alignment with the utilities passageway of the lower panel to permit utilities conduits to pass through the utilities opening when the extension is secured to the lower panel.

Another aspect of the present invention is an extension panel that is securable to a lower panel of the type having a utilities passageway extending adjacent the upper edge thereof that receives utilities conduits therein. The extension panel includes an extension panel frame defining vertically-extending side edges. The extension panel frame has a horizontal lower extending between side edges and defining therewith a pair of spaced-apart lower corners. The side edges define a vertical plane extending between the side edges. The extension panel frame has a flat plate portion extending downwardly below the lower edge, and the flat plate portion is disposed transverse to the vertical plane. The flat plate portion also has a downwardly-opening utilities cut-out there through positioned in alignment with the utilities passageway when the extension panel is secured to the lower panel to permit passage of utility conduits along the utilities passageway and through the utilities cut-out.

Yet another aspect of the present invention is a bracket for interconnecting an A extension panel above a lower panel of the type having a vertical frame member with upper apertures proximate and upper end of the vertical frame member for receiving connectors of hang-on accessory units. The bracket includes an upper portion to be rigidly secured to the extension panel. A lower portion of the bracket extends below a lower edge of the extension panel when the bracket is installed to the extension panel. The lower portion is cut-out to provide clearance through the upper apertures of the vertical frame member, such that the bracket permits reception of support hooks of hang-on accessory units within the upper apertures.

Yet another aspect of the present invention is a frame member for an extension panel configured to be interconnected to a lower panel along the upper edge of the lower panel. The frame member defines at least one aperture for reception of a first type of connector of a hang-on accessory unit. A blocking member is positioned inwardly of the aperture and prevents full engagement of the second type of connector in the aperture.

Yet another aspect of the present invention is an adapter bracket for connecting a first type of hang-on accessory unit having standard-size connector hooks to a second type of partition having a lower panel and an extension panel. The bracket includes a first portion configured to receive the standard-size connector hooks and interconnect the adapter bracket with a hang-on accessory unit. The bracket also includes blocking hooks having an enlarged end portion permitting full insertion into apertures of a lower panel, yet preventing full insertion into apertures of an extension panel having blocking members positioned inwardly from the apertures to prevent excessive loading of the extension panel by the accessory unit.

Yet another aspect of the present invention is a partition system including at least a pair of side-by-side partition frames. Each of the partition frames have a rectangular perimeter defining an upper edge, and include a utilities passageway for routing utilities adjacent the upper edge of the frames. Each of the partition frames includes a connector bracket having a downwardly opening utilities cut-out aligned with the utilities passageway to permit routing of the utilities through the utilities passageway and the utilities cut-out. The connector brackets are rigidly interconnected to one another and rigidly interconnect the partition frames.

Yet another aspect of the present invention is a partition frame assembly including a lower partition frame having a pair of spaced-apart structural uprights. The lower partition frame also has a lower portion adapted to abuttingly support the lower partition frame on a floor surface, and has an upper portion defining an upper edge. The lower partition frame further includes a utilities passageway shaped for routing of utilities conduits adjacent the upper edge of the lower partition frame. An upper partition frame defining a lower edge is positioned above the lower partition frame. A pair of spaced-apart rigid structural members extend downwardly from the upper partition frame, and are positioned along side the structural uprights of the lower partition frame. The structural members are rigidly interconnected with the structural uprights of the lower partition frame, such that the upper partition frame is rigidly interconnected with the lower partition frame. The structural members have downwardly-opening apertures therethrough aligned with the utilities passageway to permit utilities conduits to pass through the aperture. The apertures permit installation of the upper partition frame to the lower partition frame without rerouting of existing utilities conduits that extend along the utilities passageway of the lower partition frame.

These and other advantages of the invention will be further understood and appreciated by those skilled in the art by reference to the following written specification, claims, and appended drawings.

BRIEF DESCRIPTION OF THE DRAWINGS

FIG. 1;

DETAILED DESCRIPTION OF PREFERRED EMBODIMENT

Figure 1A:
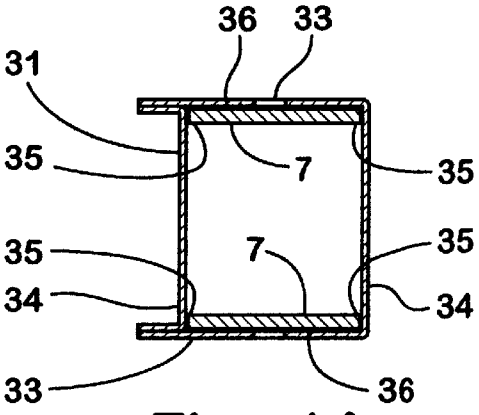
Fig. 1*a* is a cross-sectional view of the extension post of FIG. 1 taken along the line IA—IA.
Figure 1:
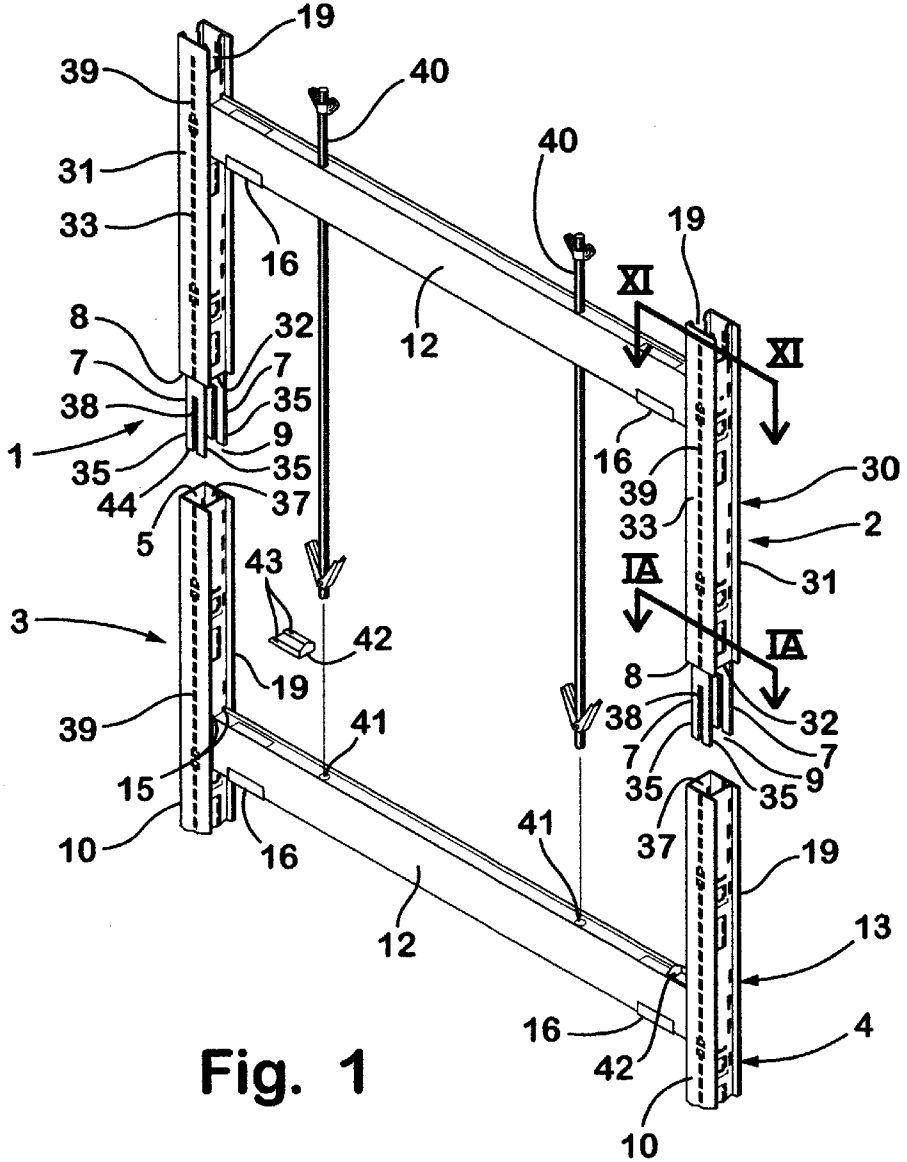
FIG. 1 is a fragmentary, exploded perspective view of a partition including a stacking bracket embodying the present invention.
Figure 2:
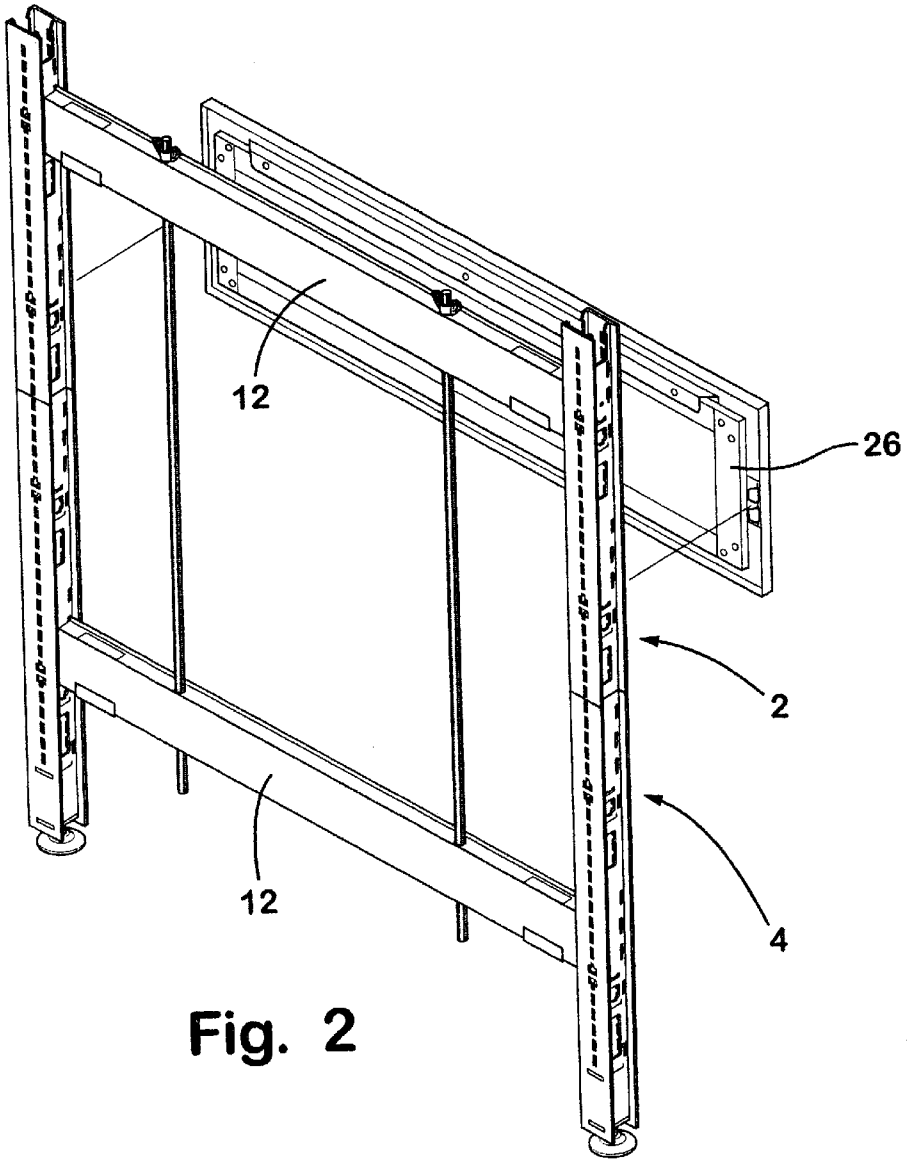
FIG. 2 is a fragmentary, partially exploded perspective view of the partition of FIG. 1.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a stacking bracket embodying the present invention, which is particularly designed for use with partition panel systems. In the illustrated example, the stacking bracket 1 comprises a connector for securing an upper panel 2 along the upper edge 3 of a lower panel 4. The lower panel 4 of the type having an upwardly-opening utilities passageway 5 (see also FIG. 4) extending along the upper edge thereof that receives lay-in utility conduits such as power or communications cabling 6. A pair of structural members 7 extend downwardly below a lower edge 8 of the upper panel 2. The structural members are shaped to engage the lower panel 4 and rigidly connect the upper panel 2 and lower panel 4. The structural members 7 are laterally spaced-apart and define a downwardly opening utilities opening 9 therebetween. The utilities opening 9 is positioned generally in alignment with the utilities passageway 5 to permit utility conduits 6 to pass through the utilities opening 9 when the upper panel 2 is secured to the lower panel 4.

Figure 3:
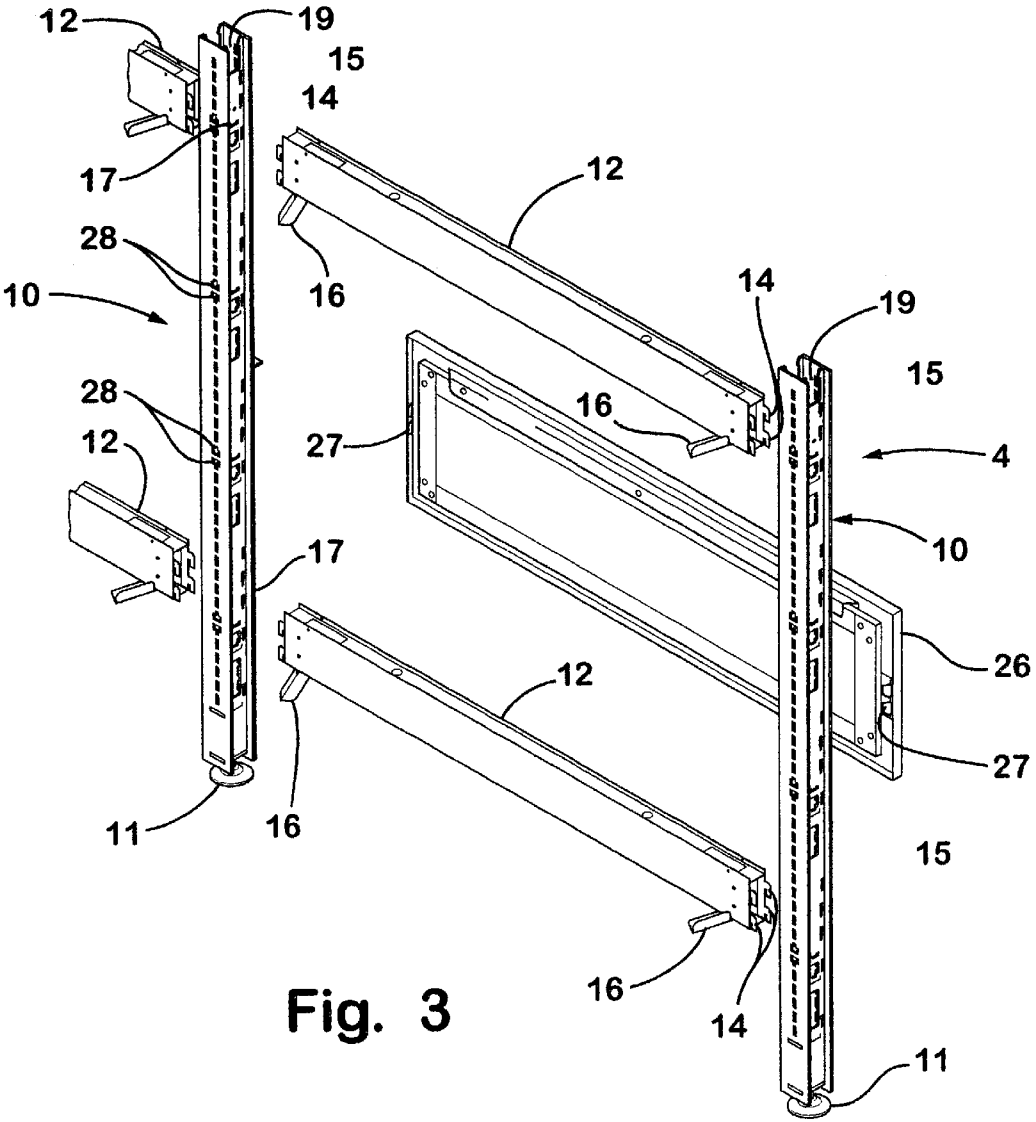
FIG. 3 is an fragmentary, exploded perspective view of the partition of FIG. 1.
Figure 4:
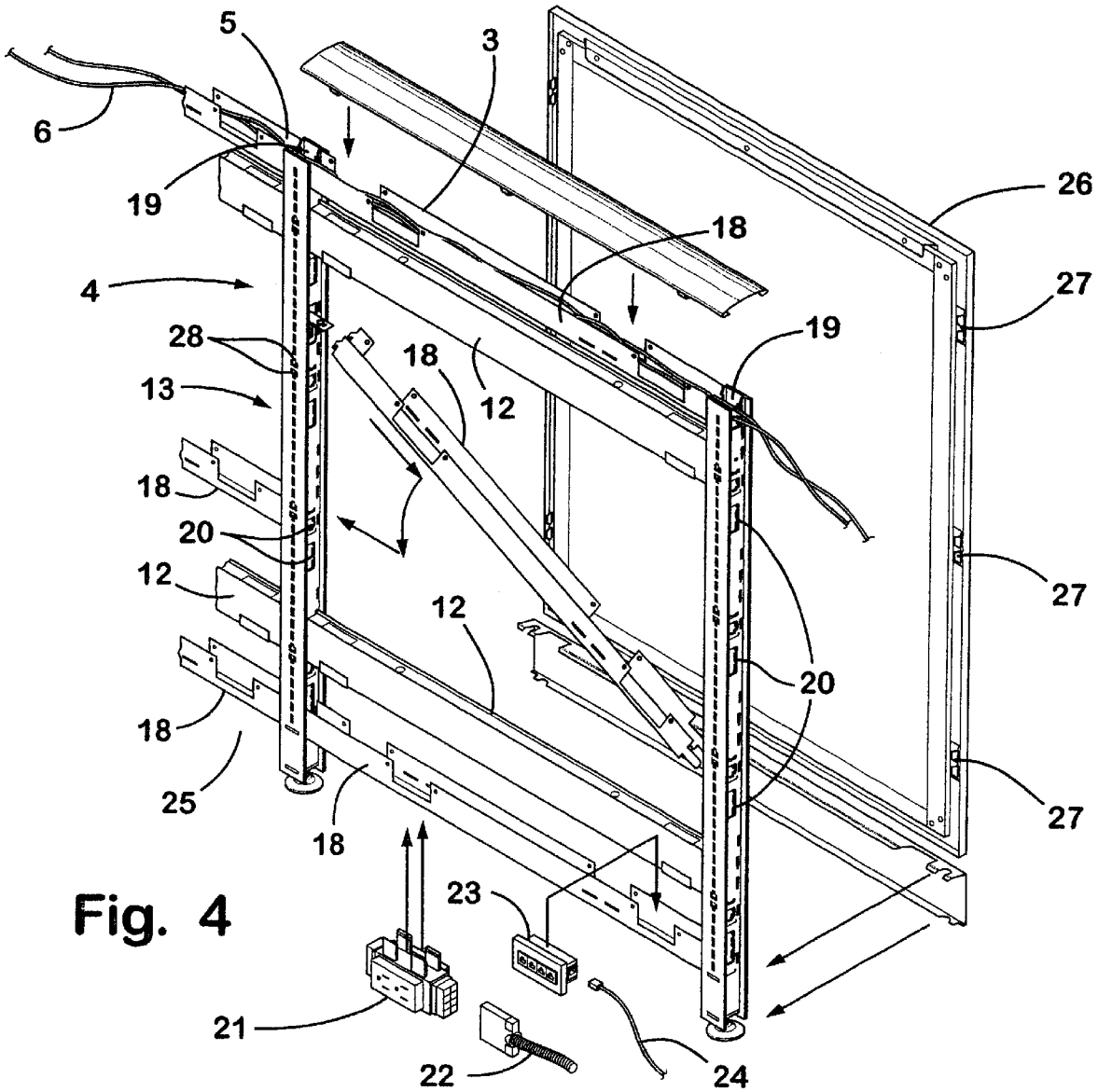
FIG. 4 is a partially exploded fragmentary perspective view of the partition of FIG. 1.

With further reference to FIGS. 3 and 4, a standard Steelcase ANSWER partition panel 4 includes vertical posts 10, each of which has an adjustable glide 11 on the lower end thereof. As described in detail in the above-identified co-pending U.S. patent application Ser. No. 09/060,913 entitled KNOCK-DOWN PORTABLE PARTITION SYSTEM, filed on Apr. 15, 1998, beams 12 extend between the posts 10, and rigidly interconnect the posts 10 to form a rigid panel frame 13. Posts 10 and beams 12 are made from metal, such as steel, and have a tubular, quadrilateral cross-section. Each beam 12 includes four hooks 14 at the opposite ends that are received within apertures 15 in the posts 10 when in the assembled condition. Each beam 12 further includes a lock member 16 that is movably mounted on each end of the beam 12. Lock members 16 shift between a locked position and unlocked position. When the lock member 16 is in the locked position, the lock member 16 engages an aperture 17 in the posts 10, and ensures the hooks 14 cannot disengage the apertures 15. The panel 4 may include one or more utility troughs 18, each of which is formed from metal and has a generally upwardly opening U-shaped cross-section. As best seen in FIG. 4, the utility troughs 18 may be placed along the top edge 3 of the panel 4, thereby forming utilities passageway 5 running along the top edge 3 of panel 4. Each of the posts 10 includes an upwardly-opening cut-out 19 that aligns with the utility troughs 18 along the upper edge 3 of the panel 4 to permit lay-in of utility conduits 6. A plurality of openings 20 through posts 10 provide clearance for passage-through of utility conduits 6 through the central portion of the panel 4. Power receptacles 21 may be mounted to the utility troughs 18, and power lines 22 routed to the power receptacles 21 through the panel 4. Similarly, communications receptacles 23 may also be mounted to the utility troughs 18 at various heights and locations, and communications lines 24 routed through the panel 4. Accordingly, the various utilities may be routed along either the top edge 3, lower edge 25, or central portions of the panel 4. Cover panels 26 include clips 27 that are received within apertures 28 of posts 10 to thereby retain the cover panels 26 on the panel frame 13.

With reference to FIG. 1, upper panel 2 includes an extension panel frame 30 that includes a standard beam 12, and a pair of extension posts 31. Extension posts 31 have substantially the same construction as posts 10, except that structural members 7 are provided at the lower end of posts 31 for connection to lower posts 10. The structural members 7 comprise flat metal plates that are received within the open lower ends 32 of extension posts 31. Posts 10 and extension posts 31 each have a generally quadrilateral, tubular cross-sectional shape, and each structural member 7 is welded or otherwise secured to the inner side of the sidewalls 33 of extension posts 31 (see also FIG. 1A). The side edges 35 of structural members 7 closely abut the opposite sidewalls 34 of extension posts 31, and also closely abut the corresponding opposite sidewalls 34 of posts 10 when in the assembled condition. The outer sides 36 of structural members 7 also closely abut the inner side surfaces 37 of lower posts 10 when assembled. Because the side edge 35 and outer sides 36 of structural members 7 abuttingly engage the inner sidewalls of post 10, the extension post 31 is retained in alignment with the lower post 10. Each structural member 7 includes a cut-out slot 38 that aligns with the vertical row of apertures 39 in the lower post 10, such that the stacking bracket 1 does not interfere with the apertures 39 that are used for receiving hang-on accessory units. A pair of elongated tie bolts 40 extend through the beam 12 of the extension panel frame 30, and through openings 41 in the beam 12 of the lower panel frame 13, and rigidly interconnect the extension panel 30 and lower panel frame 13. A clip 42 may be used to support the extension posts 31. Clip 42 includes a pair of end portions 43 that extend into the upper portion of apertures 15 directly adjacent hooks 14 of beams 12. When installed, the lower edge 44 of structural member 7 contacts the clip 42, thereby limiting the engagement of structural member 7 within lower posts 10. Extension posts 31 include a plurality of apertures 39 for receiving hang-on accessory units or the like, and also include an upwardly-opening cut-out 19 that is substantially the same as cut-out 19 of posts 10 for lay-in of utility conduits along the upper edge of the extension panel frame.

Figure 6:
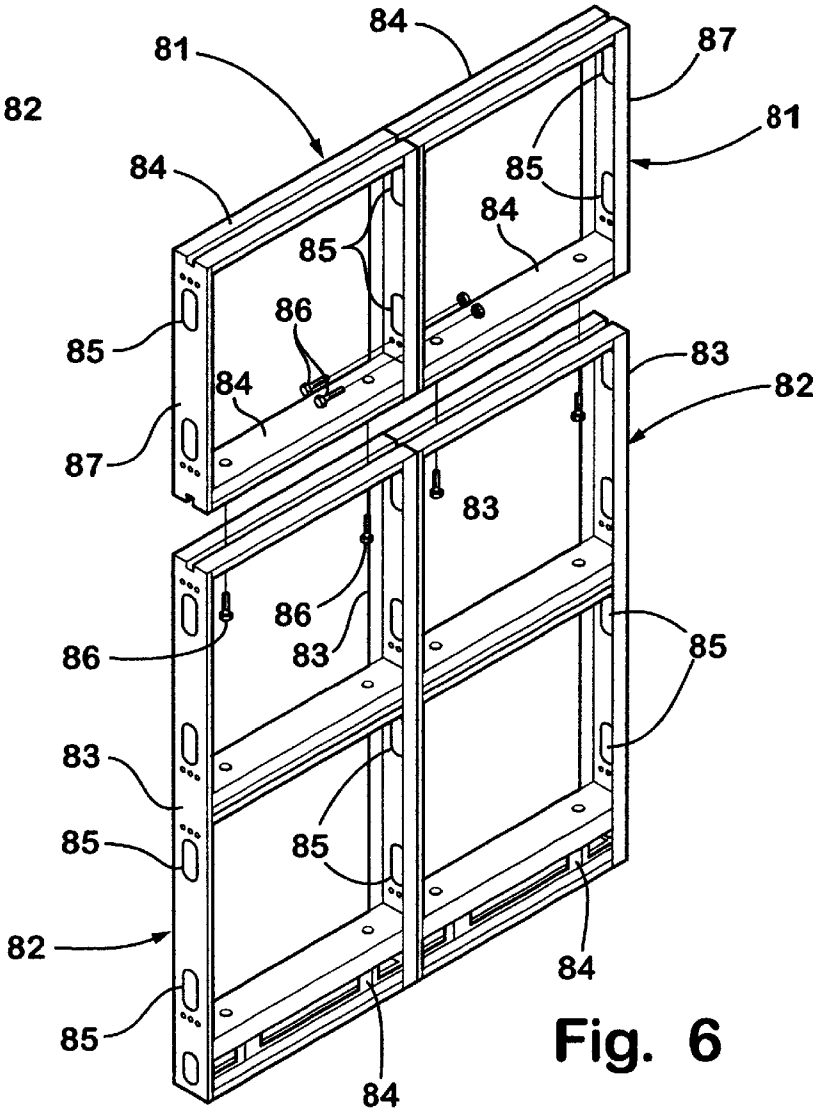
FIG. 6 is a perspective view of a prior art Steelcase MONTAGE® panel frame showing the prior art stacking arrangement.
Figure 5:
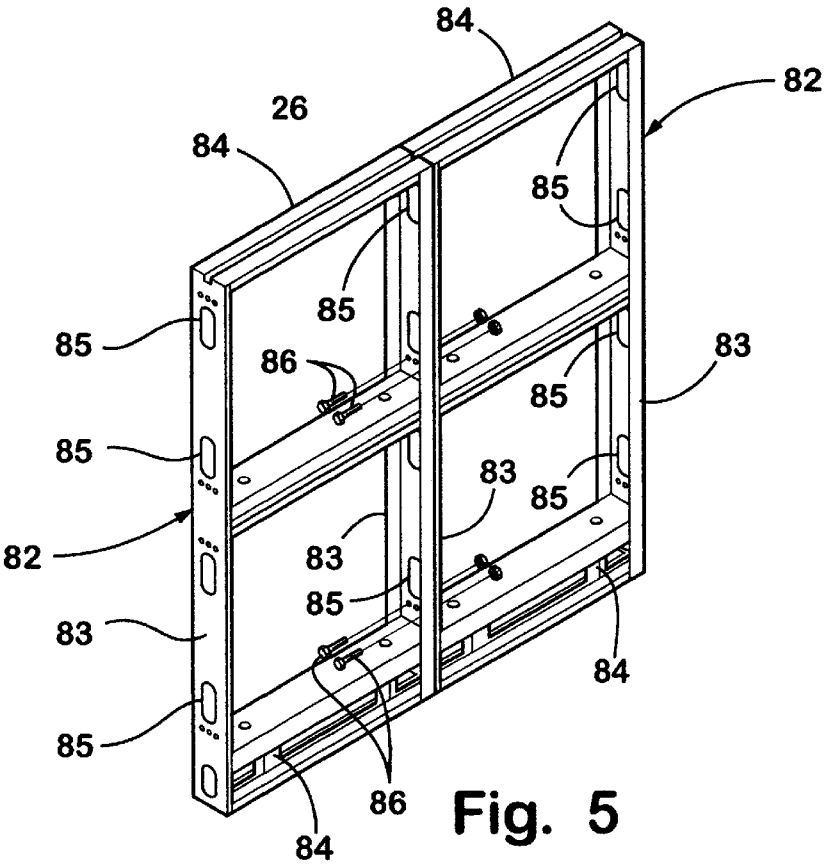
FIG. 5 is a perspective view of a pair of side-by-side prior art Steelcase MONTAGE® panel frames illustrating the frame-to-frame interconnection.
Figure 7:
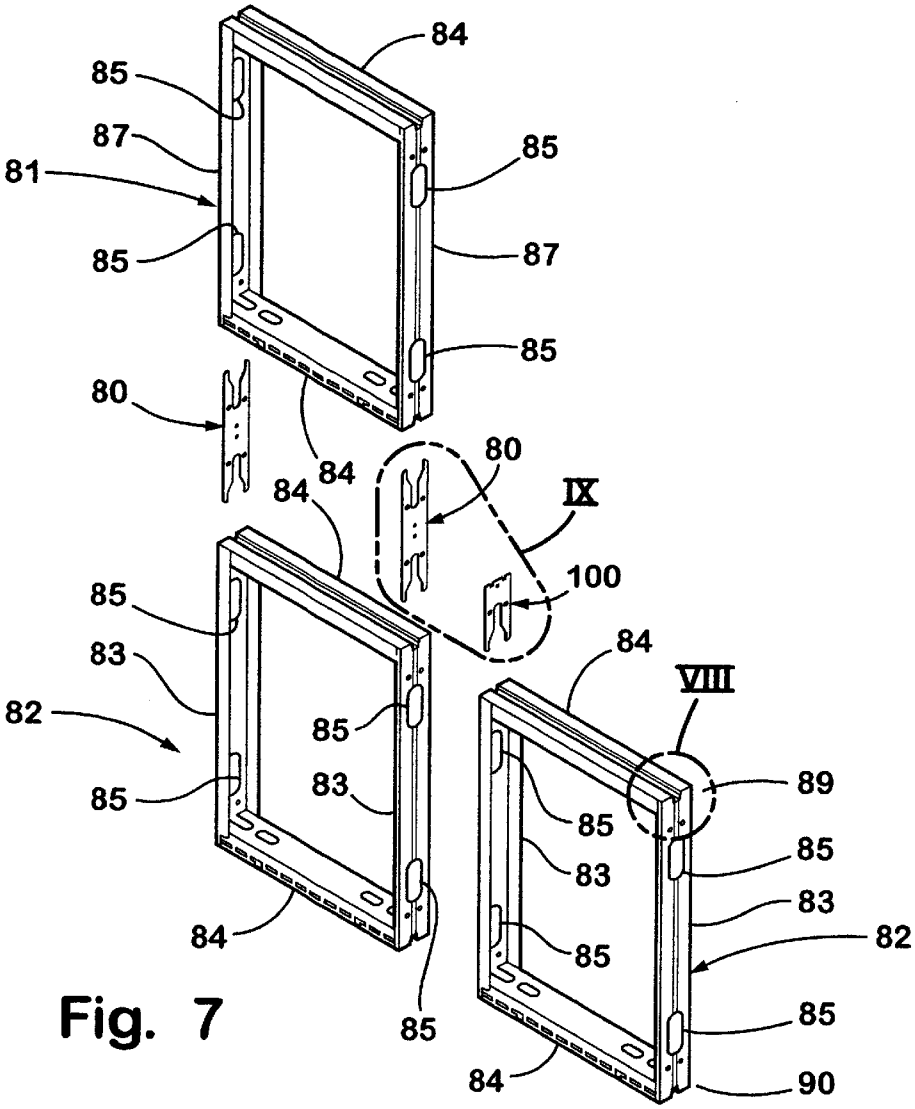
FIG. 7 is an exploded perspective view showing a modified Steelcase MONTAGE® panel frame interconnected by a second embodiment of the stacking bracket of the present invention.

A second embodiment of the stacking bracket of the present invention, designated 80 in FIG. 7, replaces the conventional Steelcase MONTAGE® stacking panel 81 illustrated in FIG. 6. The existing prior art MONTAGE® frames 82 illustrated in FIGS. 5 and 6 include a pair of vertical frame members 83 forming the side edges of the frames 82, and vertically spaced-apart horizontal frame members 84 forming the upper and lower edges of the frame 82. The vertical frame members 83 include a plurality of openings 85 therethrough to accommodate horizontal routing of utility lines such as communications and power cabling (not shown). As illustrated in FIG. 5, a pair of side-by-side frames 82 are interconnected by conventional bolts or conventional fasteners 86 that extend through the vertical frame members 83.

The stacking frame 82 is similar to the lower frames 82, and includes vertical side frame members 87 with openings 85 for communications and power lines and the like. The stacking frame 81 also includes vertically spaced-apart horizontal frame members 84 that rigidly interconnect the vertical stacking frame members 87 to form the stacking frames 81. As illustrated in FIG. 6, a side-by-side pair of the stacking frames 81 are interconnected using standard conventional fasteners 86, and the stacking frames 81 are secured to the lower frames 82 using conventional fasteners 86.

Figure 8:
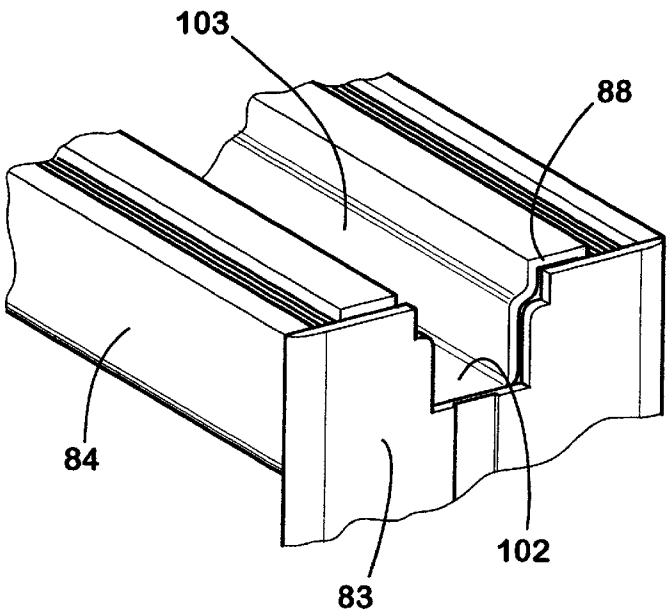
FIG. 8 is a fragmentary perspective view of a portion of a panel frame of FIG. 7.
Figure 10:
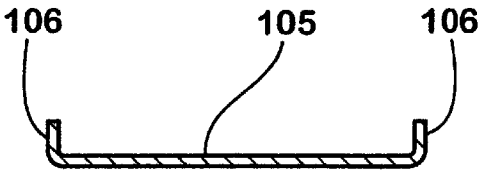
FIG. 10 is a cross-sectional view of the stacking bracket of FIG. 9 illustrating an alternate cross-sectional shape.
Figure 9:
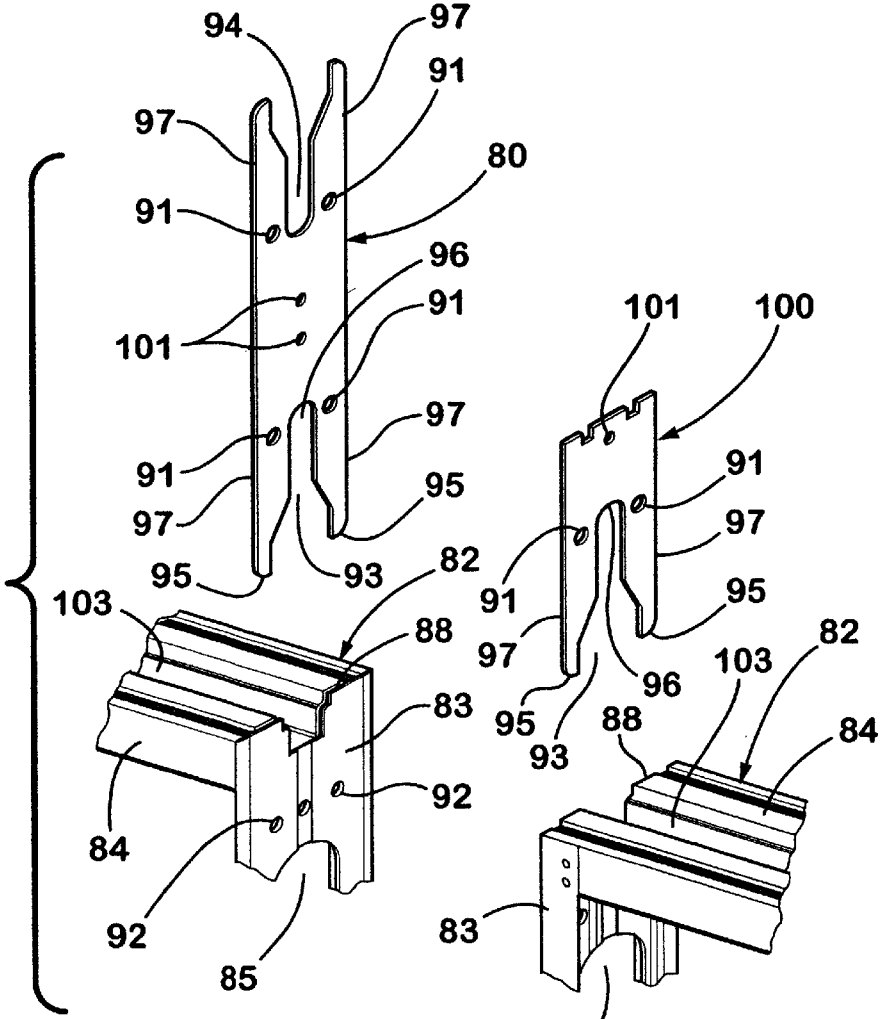
FIG. 9 is a fragmentary, exploded perspective view of the stacking bracket of FIG. 7.
Figure 12:
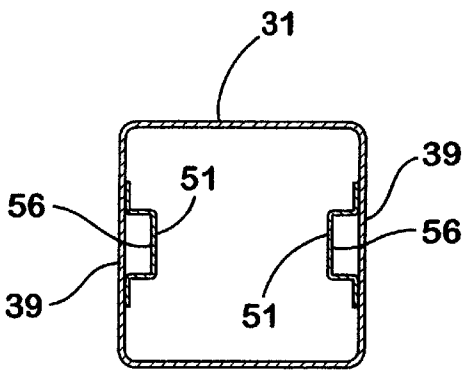
FIG. 12 is a cross-sectional view of the extension post taking along the line XI—XI.

With further reference to FIG. 7, the stacking brackets 80 of the present invention replace the conventional fasteners 86 illustrated in FIGS. 5 and 6, and discussed above. The stacking panel frame 81 and lower frames 82 illustrated in FIG. 7, are substantially the same as the stacking frame 81 and lower frame 82 of FIG. 6, except that the horizontal frame member 84 has been cut-out adjacent each vertical frame member 83 to form an opening 88. The opening 88 is formed at both the upper end 89 and lower end 90 of each vertical frame member 83 and 87. Each stacking bracket 80 includes a plurality of openings 91 that align with openings 92 in the side frame members 83 and 87 upon insertion of the stacking bracket 80 into the opening 88. Conventional fasteners such as bolts are then inserted through the openings 91 and 92 to secure the stacking bracket to the vertical frame members 83 and 87. Stacking bracket 80 includes a generally U-shaped cut-out 93 that registers with the opening 85 upon insertion of the stacking bracket 80 into opening 88. The opening 93 permits routing of utilities through the openings 85 of the frame. Similarly, an upwardly-opening cut-out 94 of stacking bracket 80 aligns with an opening 85 in the vertical side frame member 87 of the stacking panel frame 81. Bracket 100 may be used to interconnect a pair of side-by-side lower frames 82. Bracket 100 includes openings 91 that receive conventional bolts or other fasteners to secure the bracket 100 to the vertical frame member 83. A conventional bolt or other fasteners then extended through the opening 101 to secure the bracket 100 to either an adjacent stacking bracket 80 or another bracket 100 at a non-stepped location. The fasteners (not shown) that are inserted through the openings 101 are received within the channel 103 along the upper edge of the horizontal upper frame members 84, and the fasteners also extend through the cut-out portion 102 (see FIG. 8) of the vertical side frame members 83. The stacking bracket 80 and side-by-side bracket 100 are shown as being fabricated from a flat plate of metal, such as steel or other suitable material. It is anticipated that the brackets 80 and 100 could have a cross-sectional shape as illustrated in FIG. 10 including a flat base web 105, and a pair of orthogonal flanges 106 forming a generally U-shaped cross-section. The cut-outs 93 and 94 form structural members 97 corresponding to the structural members 7 described above with respect to the stacking bracket 1 illustrated in FIG. 1. It is anticipated that the flanges 106 would provide additional strength along the structural members 97 if required for a particular application. The stacking bracket 80 provides a rigid structural interconnection between the stacking frame 81 and lower frame 82, thereby permitting substantial loading of the stacking panel 81, such as by attachment of overhead storage bins and the like. In addition, the cut-out portions 93 and 94 permit routing of utilities adjacent the upper and lower edges of the panel frames, such that the utility lines in the lower frame 82 do not need to be re-routed for attachment of the stacking panel frame 81. Furthermore, the side-by-side bracket 100 permits interconnection of a pair of side-by-side frames 82, without requiring removal of the cover panels (not shown) that are installed over the frames 81 and 82 when fully assembled. Because the fastener that extends through the opening 101 is positioned within the channel 103, an installer can access the fastener without removal of the cover panels. Accordingly, bracket 100 provides a quick and convenient interconnection between a pair of side-by-side frames 82. The panel frames 81 and 82 each include a protrusion or other stop (not shown) that extends into the opening 88 and contacts the ends 95 of the structural members 97. Alternately, the stop may contact the inner end portion 96 of the opening 93 upon insertion of the bracket 80 or 100 into the opening 88. The stop properly positions the bracket 80 or 100 at the desired location, and prevents "excessive" insertion of the bracket 80 or 100 into the opening 88.

Figure 11:
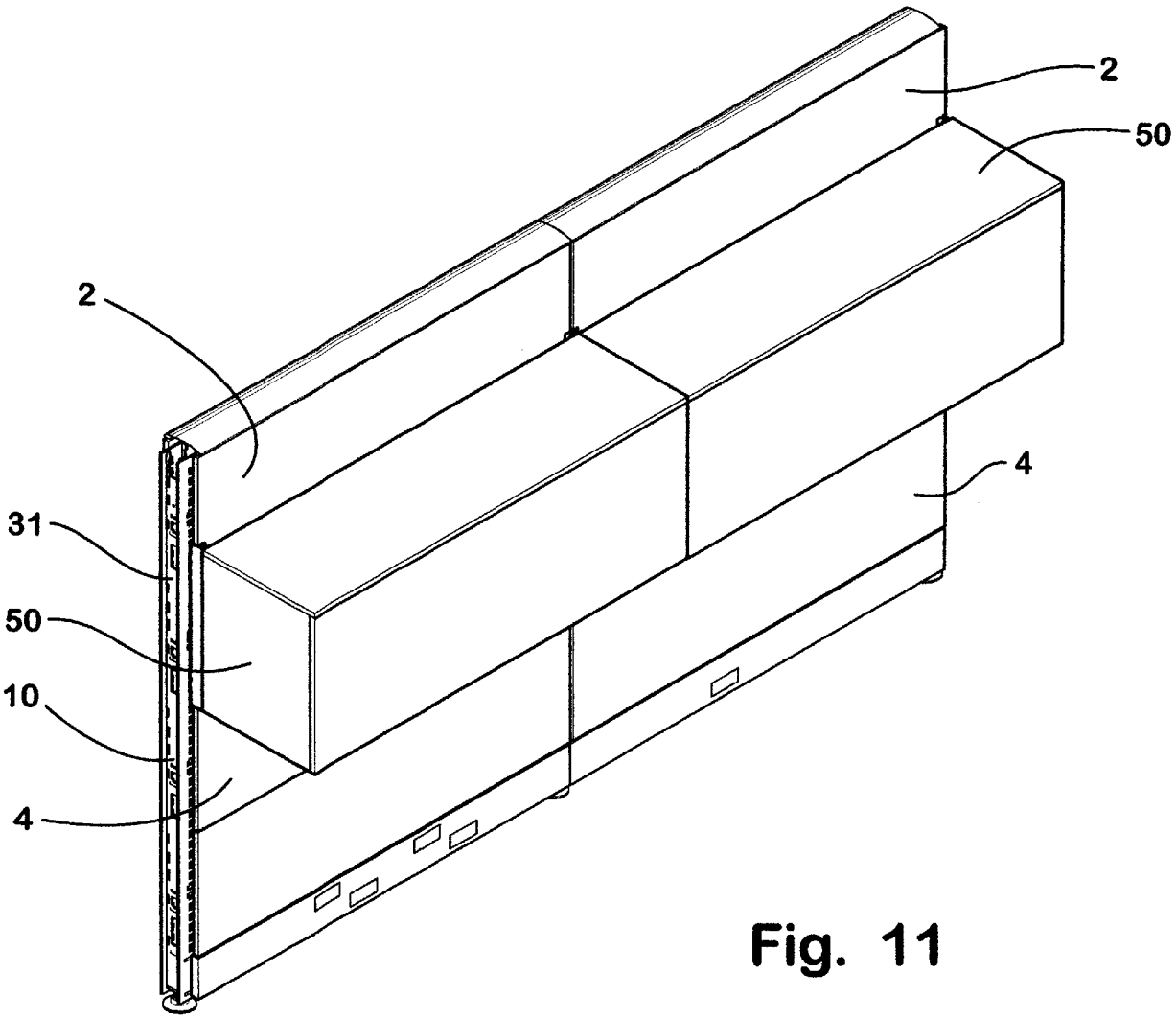
FIG. 11 is a perspective view of the partition of FIG. 1 showing binder bins in the installed position.

With reference to FIG. 11, one or more storage bins 50 may be connected to the lower panels 4 or the extension panels 2. Storage bins 50 may be a standard Steelcase AVENIR® storage bin that includes a plurality of mounting hooks that are configured to be received within the vertical rows of apertures in a standard Steelcase AVENIR® partition (not shown). Bin 50 may also be mounted to the Steelcase ANSWER partition 4 utilizing an adapter bracket 52 described in detail below. Because the extension posts 31 may not have sufficient strength to support the hang-on storage bin 50, the extension posts 31 include a "hat" channel 51 extending inside post 31 along the row of apertures 39. As described below, channel 51 prevents mounting of the adapter bracket 52 and storage bin 50 to posts 31, but permits mounting of bin 50 to lower posts 10.

Figure 13:
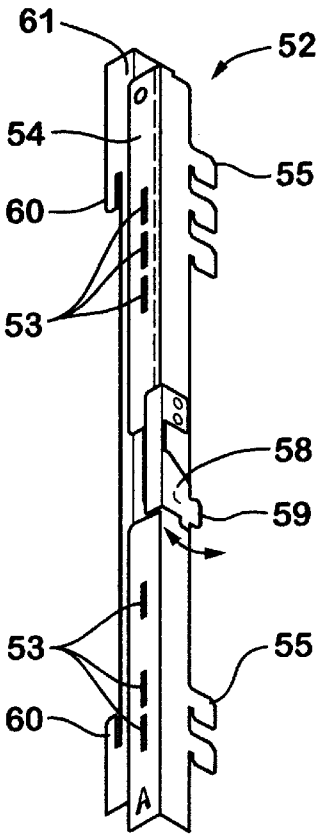
FIG. 13 is a perspective view of an adapter bracket that mounts a standard Steelcase AVENIR® storage bin to the partition of FIG. 1.
Figure 16:
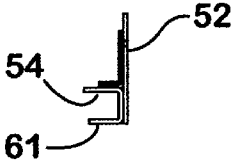
FIG. 16 is a side elevational view of the bracket of FIG. 13.
Figure 15:
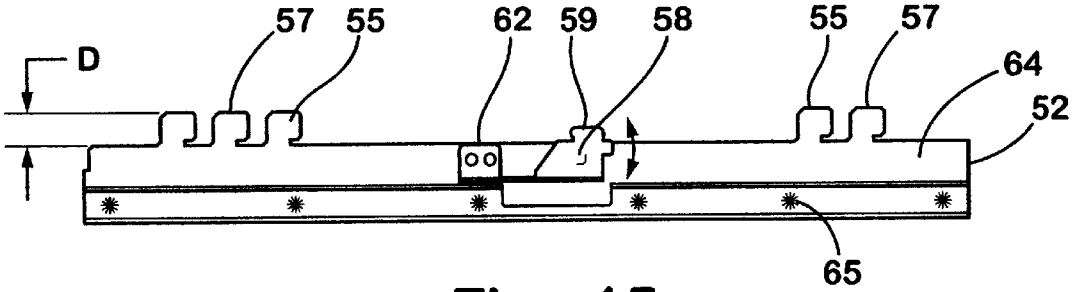
FIG. 15 is a front elevational view of the bracket of FIG. 13.
Figure 14:
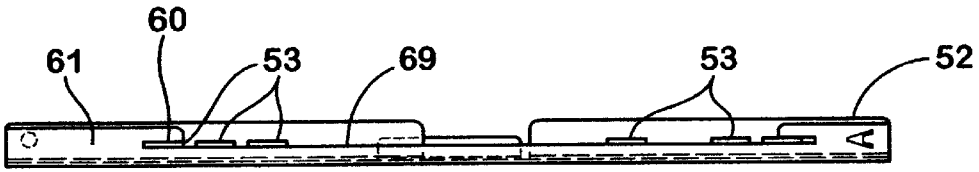
FIG. 14 is a bottom elevational view of the bracket of FIG. 13.

With further reference to FIGS. 13–15, adapter bracket 52 includes a plurality of openings 53 in web 54. The illustrated bracket 52 is a "left handed" bracket. The "right handed" bracket (not shown) is a mirror image of the illustrated bracket 52. Adapter bracket 52 includes a plurality of hooks 55, each of which has an extra-deep or "thick" end portion "D". The extra depth of hooks 55 prevents mounting of bracket 52 to the extension 31 because the edge 57 of hooks 55 contacts the inner side surface 56 of hat channel 51 if a user attempts to install the adapter bracket 52 to the extension posts 31. When the outer edge 57 of hook 55 contacts inner surface 56 of hat channel 51, hook 55 cannot fully engage the vertical row of apertures 39 in extension posts 31, thereby preventing installation of adapter bracket 52 to the upper panel 2. However, a standard Steelcase ANSWER storage bin (not shown) includes conventional standard-sized mounting hooks without extra deep end portions "D", such that the standard Steelcase ANSWER bin can be mounted either to the lower panel 4, or the upper panel 2. The standard-size hooks have a relatively small depth "D" that does not contact inner surface 56 of hat channel 51, thereby permitting installation to the extension post 31. Because the Steelcase AVENIR® bin 50 is capable of receiving a load greater than the extension panel 2 can accommodate, the adapter bracket 52 provides a safety function, and prevents installation of the AVENIR® storage bin 50 to the extension posts 31. However, lower posts 10 do not include a hat channel 51, such that the AVENIR® bin 50 may be installed to the lower posts 10 utilizing the adapter bracket 52. Similar adapter bracket arrangements utilizing extra deep hooks may also be utilized to mount other types of existing storage bins or shelves to lower posts 10, while preventing installation to extension posts 31.

Bracket 52 includes a safety clip 58 having end portion 59 that is received within an aperture 39 when in the installed position to prevent accidental dislodgment of the bracket 52 from the post 10. Safety clip 58 is made of spring steel or other suitable material, and is spot-welded or otherwise connected to the bracket 52 at 62. Web 54 is formed by one leg of L-shaped member 63 that is welded to the main bracket member 64, such as by spot-welding at 65. The main bracket member 64 includes a perpendicular end flange 61 forming hook portions 60.

Figure 18:
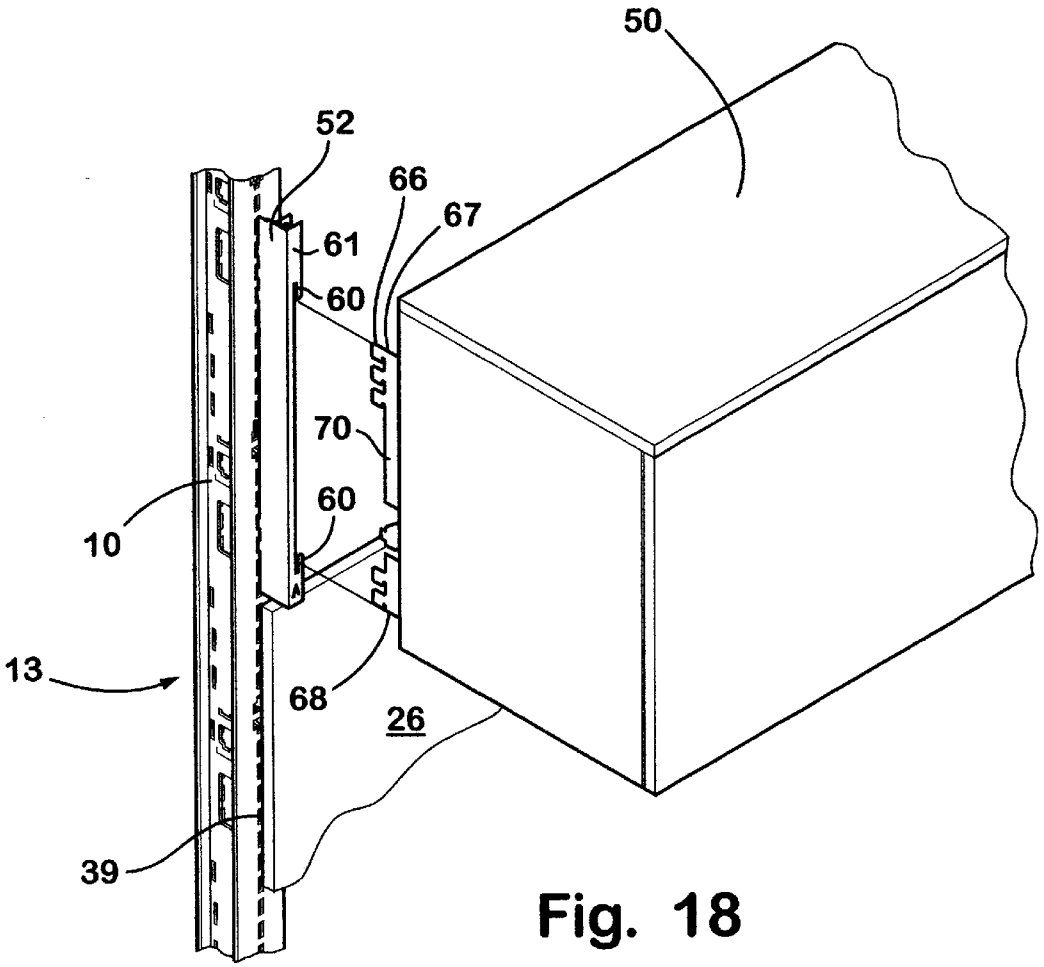
FIG. 18 is an exploded, fragmentary, perspective view showing installation of a standard Steelcase AVENIR® storage bin to the adapter bracket of FIG. 13.
Figure 17:
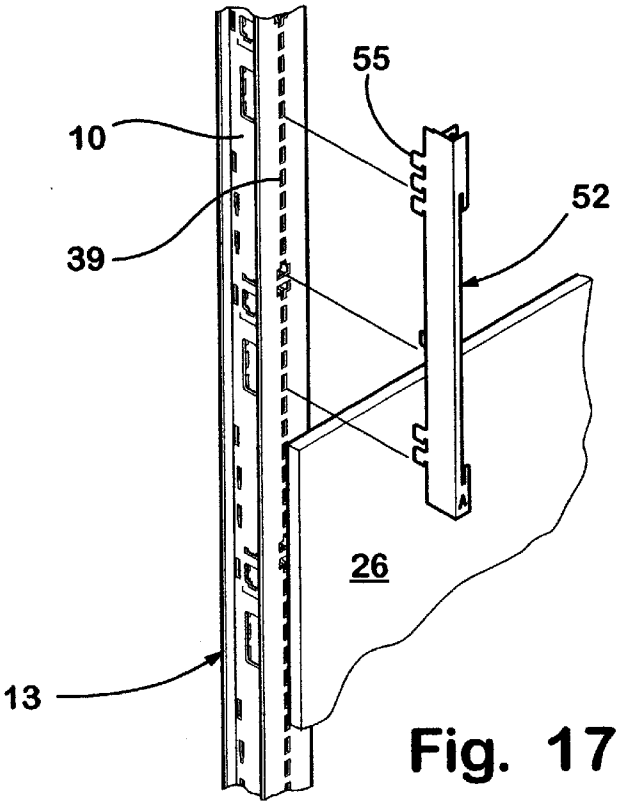
FIG. 17 is an exploded, fragmentary perspective view showing installation of the bracket of FIG. 13 to a partition panel.

With further reference to FIGS. 17 and 18, during installation, the hooks 55 of each adapter bracket 52 are inserted into the vertical row of apertures 39 in a lower post 10. The hooks 66 of the storage bin 50 are then inserted in the openings 53 in adapter bracket 52 to secure the binder bin 50 to the adapter bracket 52. When installed, the hook portions 60 of end flange 61 of adapter bracket 52 fit around the upper edge 67 and lower edge 68 of the hooks 66 of bin 50 to thereby stabilize the adapter bracket 52. When installed, the side edge 69 of flange 61 also engages the side surface 70 of hooks 66 of storage bin 50. The combination of the engagement of hooks 66 in openings 53, and the engagement of the side edge 69 and hook portion 60 with the upper edge 67 and lower edge 68, and the side surfaces 70 of hooks 66, ensure that the adapter bracket 52 is stable, and does not rotate about a vertical axis.

The stacking bracket 1 of the present invention permits a stacking panel to be quickly and easily connected to a lower panel, without requiring the removal and/or rerouting of utilities extending along the upper edge of the lower panel. The adapter brackets of the present invention prevent accidental mounting of a storage bin to the stacker panel in a position unsuited for a higher loaded storage bin.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An extension panel for connection to a lower panel of the type having vertical uprights defining upper ends and including a utilities passageway extending along an upper edge of the lower panel for receiving utility conduits therein, said extension panel comprising:

a pair of spaced-apart upright posts, each having a lower end;

at least one beam extending between said posts and rigidly interconnecting the same;

a pair of structural members extending downwardly from each said lower and of each post to engage the upper ends of the vertical uprights of the lower panel and rigidly interconnect said extension panel and the lower panel;

said structural members laterally spaced-apart to define a transverse, downwardly-opening utilities opening therebetween, said utilities opening positioned in alignment with said utilities passageway of the lower panel to permit utility conduits to pass through said utilities opening when said extension panel is secured to the lower panel.

2. The extension panel set forth in claim 1, wherein:

said posts of said extension panel include apertures therein for receiving connectors of hang-on accessory units; and said structural members have sufficient strength to permit support of hang-on accessory units from said apertures of said extension panel.

3. The extension panel set forth in claim 2, including:

at least one threaded fastener adapted to interconnect the extension and lower panels.

4. The extension panel set forth in claim 3, wherein:

said structural members are shaped to be received within openings in the upper ends of the vertical uprights of the lower panel.

5. The extension panel set forth in claim 4, wherein:

said structural members comprise spaced-apart plate members.

6. The extension panel set forth in claim 5, wherein:

said structural members each include an opening therethrough to provide clearance for connectors of a hang-on accessory unit mounted on the vertical uprights of the lower panel.

7. An extension panel securable to a lower panel of the type having a utilities passageway extending adjacent the upper edge thereof that receives conduits therein, said extension panel comprising:

an extension panel frame defining vertically-extending side edges and a horizontal lower edge extending between said side edges and defining therewith a pair of spaced-apart lower corners, said side edges defining a vertical plane extending between said side edges;

said extension panel frame having a flat plate portion extending downwardly below said lower edge, said flat plate portion disposed transverse to said vertical plane; and said flat plate portion having a downwardly-opening utilities cut-out therethrough positioned in alignment with said utilities passageway when said extension panel is secured to a lower panel to permit passage of utility conduits along said utilities passageway and through said utilities cut-out opening.

8. The extension panel set forth in claim 7, wherein:

said flat plate portion includes a pair of spaced apart downwardly extending structural connectors defining said utilities cut-out therebetween.

9. The extension panel set forth in claim 8, wherein:

said extension panel includes an extension frame having apertures for receiving connectors of hang-on accessory units; and said extension frame and said flat plate portions have sufficient strength to permit support of hang-on accessory units from said extension frame.

10. The extension panel set forth in claim 9, wherein:

said cut-out through said plate portion is U-shaped.

11. The extension panel set forth in claim 10, including:

at least one fastener extending through said flat plate portion to interconnect said extension frame to the lower panel.

12. An extension panel securable to a lower panel of the type having a utilities passageway extending adjacent the upper edge thereof that receives conduits therein, said extension panel comprising:

an extension panel frame defining vertically-extending side edges and a horizontal lower edge extending between said side edges and defining therewith a pair of spaced-apart lower corners, said side edges defining a vertical plane extending between said side edges;

said extension panel frame having a flat plate portion extending downwardly below said lower edge, said flat plate portion disposed transverse to said vertical plane;

said flat plate portion having a downwardly-opening utilities cut-out therethrough positioned in alignment with said utilities passageway when said extension panel is secured to a lower panel to permit passage of utility conduits along said utilities passageway and through said utilities cut-out opening; said flat plate portion including a pair of spaced apart downwardly extending structural connectors defining said utilities cut-out therebetween;

said extension panel including an extension frame having apertures for receiving connectors of hang-on accessory units; and said extension frame and said flat plate portions having sufficient strength to permit support of hang-on accessory units from said extension frame;

at least one fastener extending through said flat plate portion to interconnect said extension frame to the lower panel; and wherein:

said flat plate portion comprises a discrete connector bracket having an elongated member defining opposite ends, each said end having a U-shaped cut-out forming a utilities opening through said flat plate.

13. The extension panel set forth in claim 12, wherein:

said extension frame includes a pair of spaced-apart vertical frame members and upper and lower frame members extending therebetween and rigidly interconnecting said vertical frame members to define a rectangular perimeter of said extension frame, said lower frame member having openings in opposite ends thereof adjacent said vertical frame members;

said connector bracket received through a selected one of said openings in said lower frame members and secured to a selected one of said side frame members.

14. A bracket for interconnecting an extension panel above a lower panel of the type having a vertical frame member with upper apertures proximate an upper end of said vertical frame member for receiving connectors of hang-on accessory units, said bracket comprising:

an upper portion shaped to be rigidly secured to said extension panel;

a lower portion adapted to extend below a lower edge of the extension panel when said bracket is installed to the extension panel; said lower portion including a transverse, elongated U-shaped cut-out to provide clearance through said upper apertures such that said bracket permits reception of support hooks of hang-on accessory units within said upper apertures;

said bracket including a downwardly-opening utilities opening permitting reception of utilities conduits therein, such that said bracket can be installed to a lower panel having utilities conduits extending along an upper edge thereof; and wherein:

said bracket comprises spaced-apart plates defining said utilities opening therebetween.

15. The bracket set forth in claim 14, wherein:

each plate has an opening therethrough providing clearance for support hooks of hang-on accessory units.

16. A frame member for an extension panel configured to be interconnected to a lower panel along the upper edge of the lower panel;

said frame member defining at least one aperture adapted for reception of a first type of connector of a hang-on accessory unit; and including a blocking member positioned inwardly of said aperture and extending across at least a portion of said aperture to prevent full engagement of a second type of connector in said aperture.

17. A frame member as set forth in claim 16, wherein:

said frame member defines a sidewall having a vertical row of apertures therethrough; and said blocking member extends along on inner side of said sidewall with at least a portion thereof in alignment with said apertures and spaced inwardly of said sidewall to permit full insertion of a first type of connector, yet preventing full insertion of a second type of connector.

18. A frame member as set forth in claim 17, wherein:

said blocking member comprises an elongated hat-shaped member extending along said apertures, and in alignment therewith.

19. A frame member as set forth in claim 18, including:

a hang-on accessory unit having a first type connector and a second type connector;

said first type of connector comprising a hook having an end portion defining a standard width, and said second type of connector comprising a hook having an end portion defining a width greater than said standard width and preventing full insertion of said second type connector in said apertures.

20. An adapter bracket for connecting a first type of hang-on accessory unit having standard-sized connector hooks to a second type of partition having a lower panel and an extension panel, said bracket comprising:

a first portion configured to receive said standard-sized connector hooks and interconnect said adapter bracket with a hang-on accessory unit; and blocking hooks having an enlarged end portion permitting full insertion into apertures of a lower panel, yet preventing full insertion into apertures of an extension panel having blocking members positioned inwardly from the apertures to thereby prevent excessive loading of said extension panel by said accessory unit.

21. The adapter bracket of claim 20, wherein:

said blocking hooks have a free end portion defining a width sufficiently large to prevent insertion into the apertures of an extension panel having a blocking member spaced inwardly in alignment with the apertures.

22. The adapter bracket of claim 21, wherein:

said first portion includes a row of apertures adapted to receive connector hooks of a hang-on accessory unit.

23. A partition system including at least a pair of side-by-side partition frames, each having a rectangular perimeter defining an upper edge and including a generally horizontal utilities passageway for routing utilities adjacent said upper edge of said frames, and wherein:

each said partition frame includes a connector bracket having a pair of downwardly extending extensions that are spaced apart to define downwardly-opening utilities cut-out aligned with said utilities passageway to permit generally horizontal routing of utilities through said utilities passageway and through said utilities cut-out, said connector brackets rigidly interconnected to one another and rigidly interconnecting said partition frames.

24. The partition system set forth in claim 23, wherein:

said partition frames each include a horizontal frame member having opposite ends and defining a top edge of said frame, said partition frames including a pair of vertical side frame members rigidly interconnected with said opposite ends of said horizontal frame member and defining opposite side edges of said partition frames, each of said partition frames having an opening through said horizontal frame members adjacent a selected one of said vertical side frame members; and wherein:

said connector bracket comprises a first connector bracket; and including:

a second connector bracket;

said connector brackets received within said openings in said horizontal frame member and positioned in alignment with one another in said partition frames, said connector brackets rigidly interconnected with said partition frames and with one another to thereby rigidly interconnect said partition frames.

25. A partition frame assembly, comprising:

a lower partition frame including a pair of spaced-apart structural uprights, said lower partition frame having a lower portion adapted to abuttingly support said lower partition frame on a floor surface, said lower partition frame having an upper portion defining an upper edge, said lower partition frame further including a utilities passageway shaped for routing of utilities conduits adjacent said upper edge;

an upper partition frame positioned above said lower partition frame, said upper partition frame defining a lower edge;

a pair of spaced-apart rigid structural members extending downwardly from said upper partition frame;

said structural members rigidly interconnected with said structural uprights of said lower partition frame such that said upper partition frame is rigidly interconnected with said lower partition frame; and each structural member comprising a pair of rigid members extending downwardly therefrom said rigid member spaced apart to define a downwardly-opening U-shaped aperture therebetween, said apertures aligned with said utilities passageway to permit generally horizontal utilities conduits to pass through said aperture, and permitting installation of said upper partition frame to said lower partition frame without rerouting of existing utilities conduits extending along said utilities passageway of said lower partition frame.

26. The partition frame assembly set forth in claim 25, wherein:

said lower partition frame includes a pair of vertically spaced-apart beams extending between said structural uprights, said beams having opposite ends thereof rigidly yet releasably interconnected with said structural uprights.

27. The partition frame assembly set forth in claim 26, wherein:

said lower partition frame includes an upwardly-opening utilities passageway extending along said upper edge of said lower partition frame.

28. The partition frame assembly set forth in claim 27, wherein:

said lower partition frame includes [a] an elongated utility trough member positioned above said beams forming said utilities passageway.

29. The partition frame assembly set forth in claim 25, wherein:

said upper partition frame includes a pair of spaced-apart upper posts extending upwardly relative to said structural uprights of said lower partition panel; and each upper post defining a lower end having a pair of Aid spaced-apart rigid members extending downwardly therefrom, said rigid members interconnected with said structural uprights to rigidly interconnect said upper and lower partition frames.

30. The partition frame assembly set forth in claim 29, wherein:

said upper posts and said structural uprights comprise tubular members, each having substantially the same cross-sectional shape and defining inner surfaces;

said rigid members comprise plates abutting said inner surfaces of said upper posts and said structural uprights.

31. The partition frame assembly set forth in claim 30, wherein:

said structural uprights define opposite side faces, each of which includes a vertical row of apertures for supporting hang-on accessory units; and each said plate including at least one aperture therethrough positioned in alignment with said vertical rows of apertures in said structural uprights when assembled to provide clearance for hooks of hang-on accessory units.

32. The partition frame assembly set forth in claim 25, wherein:

said upper partition frame includes horizontally spaced-apart upper structural uprights vertically aligned with said structural uprights of said lower partition frame; and said structural members comprise flat plates having a downwardly-opening U-shaped aperture therethrough positioned in alignment with said utilities passageway when said upper partition frame is installed on said lower partition frame.

33. The partition frame assembly set forth in claim 32, wherein:

said utilities passageway includes apertures through said structural uprights of said lower partition frame.

* * * * *